US012111092B2

(12) United States Patent
Cheng et al.

(10) Patent No.: US 12,111,092 B2
(45) Date of Patent: Oct. 8, 2024

(54) REFRIGERATING AND FREEZING DEVICE

(71) Applicants: QINGDAO HAIER SPECIAL REFRIGERATION ELECTRIC APPLIANCE CO., LTD., Shandong (CN); QINGDAO HAIER REFRIGERATOR CO., LTD., Shandong (CN); HAIER SMART HOME CO., LTD., Shandong (CN)

(72) Inventors: Xueli Cheng, Qingdao (CN); Bin Fei, Qingdao (CN); Chunyang Li, Qingdao (CN); Lisheng Ji, Qingdao (CN)

(73) Assignees: QINGDAO HAIER SPECIAL REFRIGERATION ELECTRIC APPLIANCE CO., LTD., Shandong (CN); QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 220 days.

(21) Appl. No.: 17/628,624

(22) PCT Filed: Jul. 20, 2020

(86) PCT No.: PCT/CN2020/103036
§ 371 (c)(1),
(2) Date: Jan. 20, 2022

(87) PCT Pub. No.: WO2021/013128
PCT Pub. Date: Jan. 28, 2021

(65) Prior Publication Data

US 2022/0252321 A1 Aug. 11, 2022

(30) Foreign Application Priority Data

Jul. 22, 2019 (CN) ..... 201910661228.8

(51) Int. Cl.
*F25D 11/02* (2006.01)
*F25D 17/04* (2006.01)
(Continued)

(52) U.S. Cl.
CPC ..... *F25D 11/02* (2013.01); *F25D 17/045* (2013.01); *F25D 17/065* (2013.01); *F25D 17/08* (2013.01);
(Continued)

(58) Field of Classification Search
CPC ..... F25D 11/02; F25D 17/045; F25D 17/065; F25D 17/08; F25D 25/025; F25D 29/003;
(Continued)

(56) References Cited

U.S. PATENT DOCUMENTS

2016/0134064 A1 5/2016 Lee et al.
2018/0017306 A1* 1/2018 Miller ..... F25C 1/147

FOREIGN PATENT DOCUMENTS

CN 1752679 A 3/2006
CN 102997554 A 3/2013
(Continued)

OTHER PUBLICATIONS

Pdf is Original document of foreign reference EP 1927817 A1 (Year: 2008).*
(Continued)

*Primary Examiner* — Len Tran
*Assistant Examiner* — Kamran Tavakoldavani
(74) *Attorney, Agent, or Firm* — ALSTON & BIRD LLP

(57) ABSTRACT

Provided is a refrigerating and freezing device, including: a storage compartment partitioned into a plurality of first spaces; an air channel system having a plurality of first air supply outlets, a main return air outlet and an on-off control device; and a plurality of drawers, wherein each drawer is mounted in one of the first spaces, each drawer has an air
(Continued)

inlet and a return air outlet, each air inlet is communicated with one of the first air supply outlets, and each return air outlet is communicated with the main return air outlet; and the on-off control device is configured to control air flow to one or more of the plurality of first air supply outlets, and then control all or part of the air flow to flow to the corresponding drawers.

11 Claims, 10 Drawing Sheets

(51) Int. Cl.

| | |
|---|---|
| ***F25D 17/06*** | (2006.01) |
| ***F25D 17/08*** | (2006.01) |
| ***F25D 25/02*** | (2006.01) |
| ***F25D 29/00*** | (2006.01) |

(52) U.S. Cl.
CPC ..... *F25D 25/025* (2013.01); *F25D 29/003* (2013.01); *F25D 29/005* (2013.01); *F25D 2317/067* (2013.01)

(58) Field of Classification Search
CPC .. F25D 29/005; F25D 2317/067; F25D 19/00; F25D 19/003
See application file for complete search history.

(56) References Cited

FOREIGN PATENT DOCUMENTS

| | | | | |
|---|---|---|---|---|
| CN | 104930785 | A | 9/2015 | |
| CN | 104990333 | A | 10/2015 | |
| CN | 105157311 | A | 12/2015 | |
| CN | 205014739 | U | 2/2016 | |
| CN | 105737475 | A | 7/2016 | |
| CN | 106679265 | A | 5/2017 | |
| CN | 106679285 | A | 5/2017 | |
| CN | 107062761 | A | 8/2017 | |
| CN | 208238351 | U | 12/2018 | |
| CN | 109442861 | A | 3/2019 | |
| CN | 208567250 | U | 3/2019 | |
| CN | 110186242 | A | 8/2019 | |
| CN | 110186243 | A | 8/2019 | |
| CN | 210625072 | U | 5/2020 | |
| CN | 210625073 | U | 5/2020 | |
| CN | 210625075 | U | 5/2020 | |
| EP | 1927817 | A1 * | 6/2008 | ..... F25D 17/045 |
| EP | 2339275 | A2 | 6/2011 | |
| EP | 2339275 | A3 | 12/2014 | |
| JP | 2001280800 | A | 10/2001 | |
| JP | 2010-71486 | A | 4/2010 | |
| JP | 2018-528383 | A | 9/2018 | |
| KR | 2007-0024021 | | 3/2007 | |
| KR | 100761357 | B1 | 9/2007 | |
| KR | 2009-0055133 | A | 6/2009 | |
| KR | 2016-0021397 | | 2/2016 | |
| KR | 2016-0055644 | | 5/2016 | |

OTHER PUBLICATIONS

Pdf is translation of foreign reference (Year: 2008).*
Notice of Grant for Korean Patent Application No. KR 10-2022-7000606 dated Oct. 10, 2023 (5 pages).
1st Examination Report for Australia Patent Application No. 2020318183 dated Oct. 24, 2022 (3 pages).
1st Office Action for Japan Patent Application No. 2022-503784 (6 pages).
Search Report for EP Application No. 20843116.3 dated Aug. 17, 2022 (4 pages).
1st Office Action for EP Application No. 20843116.3 dated Aug. 29, 2022 (5 pages).
Notice of Intent to Grant for EP Application No. 20843116.3 dated Feb. 20, 2023 (38 pages).
International Search Report for PCT/CN2020/103036 (ISA/CN) mailed Oct. 15, 2020 with English translation (7 pages).
Written Opinion for PCT/CN2020/103036 (ISA/CN) mailed Oct. 15, 2020 (no translation yet available).
Notice of Acceptance for Australia Patent Application No. 2020318183 dated Mar. 16, 2023 (3 pages).
Decision to Grant for Japan Patent Application No. 2022-503784 (3 pages).
1st Office Action for Korean Patent Application No. 9-5-2023-060537462 dated Jul. 3, 2023.

* cited by examiner

REFRIGERATING AND FREEZING DEVICE

CROSS-REFERENCE TO RELATED APPLICATIONS

This application is a national phase entry of International Application No. PCT/CN2020/103036, filed Jul. 20, 2020, which claims priority to Chinese Patent Application No. 201910661228.8, filed Jul. 22, 2019, which are incorporated herein by reference in their entirety.

FIELD OF THE INVENTION

The present invention relates to the technical field of refrigeration equipment, in particular to a refrigerating and freezing device.

BACKGROUND OF THE INVENTION

With the development of social economy and the improvement of people's living standards, refrigerators have become indispensable household appliances in people's daily life. All layers of a refrigerating compartment of an existing refrigerator are unified to a temperature of 0-5° C., but the best storage temperatures of all food are different. If a user sets the temperature to a low level of 0° C., the temperature of the entire refrigerating compartment is about 0° C. If food with the best storage temperature of greater than 5° C. is stored at this temperature, the fresh-keeping cycle of the food will be shortened, and food spoilage will be accelerated.

BRIEF DESCRIPTION OF THE INVENTION

In view of the above problems, a refrigerating and freezing device is provided to overcome the above problems or at least partially solve the above problems. A plurality of drawer partitions are disposed in a refrigerating compartment of a refrigerator, and the drawer partitions can be independently adjusted for multiple temperature levels, so that a user can adjust the temperature of each partition of the refrigerator according to his/her own needs and habits, different food can be stored at the best storage environment areas, and the user can be guided to correctly place the food in the best storage spaces.

Specifically, the present invention proposes a refrigerating and freezing device, including:

a storage compartment partitioned into a plurality of first spaces;

a cooling chamber configured to accommodate an evaporator of the refrigerating and freezing device;

an air channel system having a plurality of first air supply outlets, a main return air outlet and an on-off control device; and a plurality of drawers, wherein each drawer is mounted in one of the first spaces, each drawer has an air inlet and a return air outlet, each air inlet is communicated with one of the first air supply outlets, and each return air outlet is communicated with the main return air outlet; and the on-off control device is configured to control air flow from the cooling chamber to flow to one or more of the plurality of first air supply outlets, and then control all or part of the air flow to flow to the corresponding drawers, thus controlling the temperature in the corresponding drawers.

Optionally, a rear part of the storage compartment is provided with the plurality of first air supply outlets and the main return air outlet;

a rear part of each drawer is provided with the air inlet, and a front part of each drawer is provided with the return air outlet.

Optionally, the refrigerating and freezing device further includes a level generating device configured to generate a plurality of level instruction sets; each level instruction set includes a plurality of level instructions, and correspondingly controls one of the drawers; each level instruction includes control information that controls the corresponding drawer to be at a target temperature or within a target temperature range, so that the refrigerating and freezing device controls the on-off control device according to each level instruction and then controls the temperature in the corresponding drawer.

Optionally, the level generating device includes a plurality of display control panels disposed at front parts of the respective drawers, and each display control panel is configured to receive a signal and generate the level instructions of one of the level instruction sets.

Optionally, the refrigerating and freezing device further includes a plurality of electrical connection sockets, and each electrical connection socket is disposed at a rear part of one of the first spaces; and the rear part of each drawer has an electrical connection plug inserted into the corresponding electrical connection socket to transmit signals and/or supply power; each display control panel is connected to the corresponding electrical connection plug.

Optionally, each drawer has a rear wall, a front wall, and a front plate disposed on a front side of the front wall;

the rear wall is provided with the air inlet, and the air inlet is inserted into one of the first air supply outlets;

an upper end of the front plate is connected to an upper end of the front wall to form a return air channel with an opening facing downward, and the front wall is provided with the return air outlet; and the storage compartment is partitioned into at least one second space, and the at least one second space is located on a lower side of the plurality of first spaces; a rear part of one second space is provided with the main return air outlet.

Optionally, the plurality of first spaces are arranged in at least two columns, and the first spaces in each column are sequentially disposed in a vertical direction, wherein the number of first spaces is equal or unequal in any two columns; the number of the second space is one, and a fruit and vegetable box and a sealed box below the fruit and vegetable box are disposed in the second space; and the air channel system further has a second air supply outlet communicated with the sealed box.

Optionally, the storage compartment is partitioned into a plurality of first spaces by a shelf, a front end of a bottom wall of each first space is provided with a stop bar, and a bottom front end of each drawer is provided with a stop groove or stop surface matching the corresponding stop bar, so that each stop bar hinders the drawer from moving forward after the corresponding drawer is located in the corresponding first space.

Optionally, the air channel system includes an air supply assembly, which is disposed at the rear part of the storage compartment and provided with the plurality of first air supply outlets and the plurality of electrical connection sockets.

Optionally, the on-off control device includes:

a shell having an air flow inlet, a circumferential wall of the shell having a plurality of air flow outlets; and an adjusting member rotatably disposed in the shell and having two air flow guide plates symmetrically disposed, either of the air flow guide plates being parallel to an axial direction of the shell;

one ends of the two air flow guide plates confine a first air opening; the adjusting member is configured to be rotatable to a plurality of preset positions, and the first air opening is communicated with one of the air flow outlets at each preset position, so that air flow entering between the two air flow guide plates via the air flow inlet enters the corresponding air flow outlet; and each air flow outlet is communicated with one of the drawers via the first air supply outlet; the air flow inlet is communicated with the cooling chamber.

In the refrigerating and freezing device of the present invention, the storage compartment is partitioned into a plurality of first spaces staggered, and drawers are disposed in the plurality of first spaces, or drawers are disposed in some of the first spaces, which can achieve independent partitioning of the refrigerating compartment of the refrigerator. Further, since the refrigerating and freezing device of the present invention has an on-off control device, which can achieve different temperatures in the drawers of the refrigerating compartment of the refrigerator to store different kinds of items. Free combination of temperature zones can achieve the best storage environment for different food, and the temperature and humidity are independently controlled according to user needs. A user can also determine the number of drawers mounted in the first spaces according to his/her needs.

Further, the refrigerating and freezing device has a level generating device, so that each drawer can be independently adjusted for one or more temperature levels such as 2° C., 5° C., and 10° C. (low, medium, and high), a user can adjust the temperature of each drawer of the refrigerator according to his/her own needs and habits, different food can be stored at the best environment zones through the balanced control of temperature and humidity, and the user can be guided to correctly place the food in the best storage spaces. The refrigerating and freezing device can also control the corresponding drawer according to the type of food stored and the temperature information corresponding to the type of food, that is, automatically adjust the drawer to the corresponding level according to the type of food selected by the user.

Further, in the refrigerating and freezing device of the present invention, a user can freely switch food. According to the food the user switches, the drawer automatically matches the temperature range corresponding to the food, and automatically memorizes it, so that the drawer can automatically identify its own temperature range when switched to any position.

Further, in the refrigerating and freezing device of the present invention, the creative on-off control device technology can realize independent temperature control on each drawer of the refrigerating compartment and rapid cooling, reduce temperature fluctuations of each drawer, retain freshness, save energy, and also realize independent adjustment on multiple temperature levels of each drawer to store food in the best temperature ranges, which greatly improves the fresh-keeping cycle of food, facilitates user's use and saves more energy. Because of the special structure of the on-off control device, air can be conveniently distributed. The on-off control device is simple in structure, convenient to control, high in motion stability, and good in adjustment effect.

Specific embodiments of the present invention will be described in detail below with reference to the accompanying drawings, and those skilled in the art will better understand the above and other objectives, advantages and features of the present invention.

BRIEF DESCRIPTION OF THE DRAWINGS

Hereinafter, some specific embodiments of the present invention will be described in detail in an exemplary rather than restrictive manner with reference to the accompanying drawings. In the drawings, the same reference numerals denote the same or similar parts or elements. A person skilled in the art should understand that these drawings are not necessarily drawn to scale. In figures.

DETAILED DESCRIPTION

Figure 1:
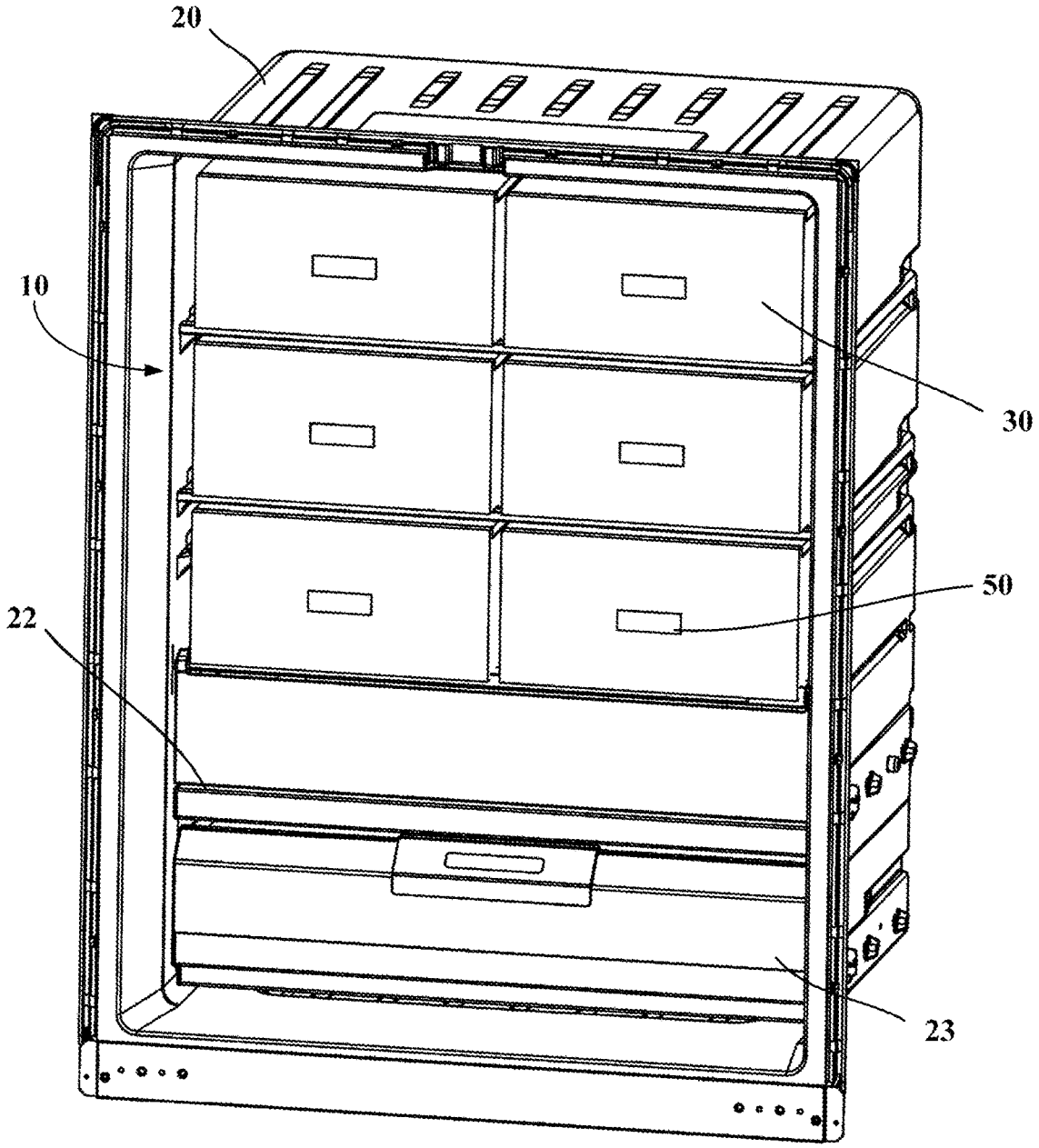
FIG. 1 is a schematic structural diagram of a refrigerating and freezing device according to an embodiment of the present invention.
Figure 2:
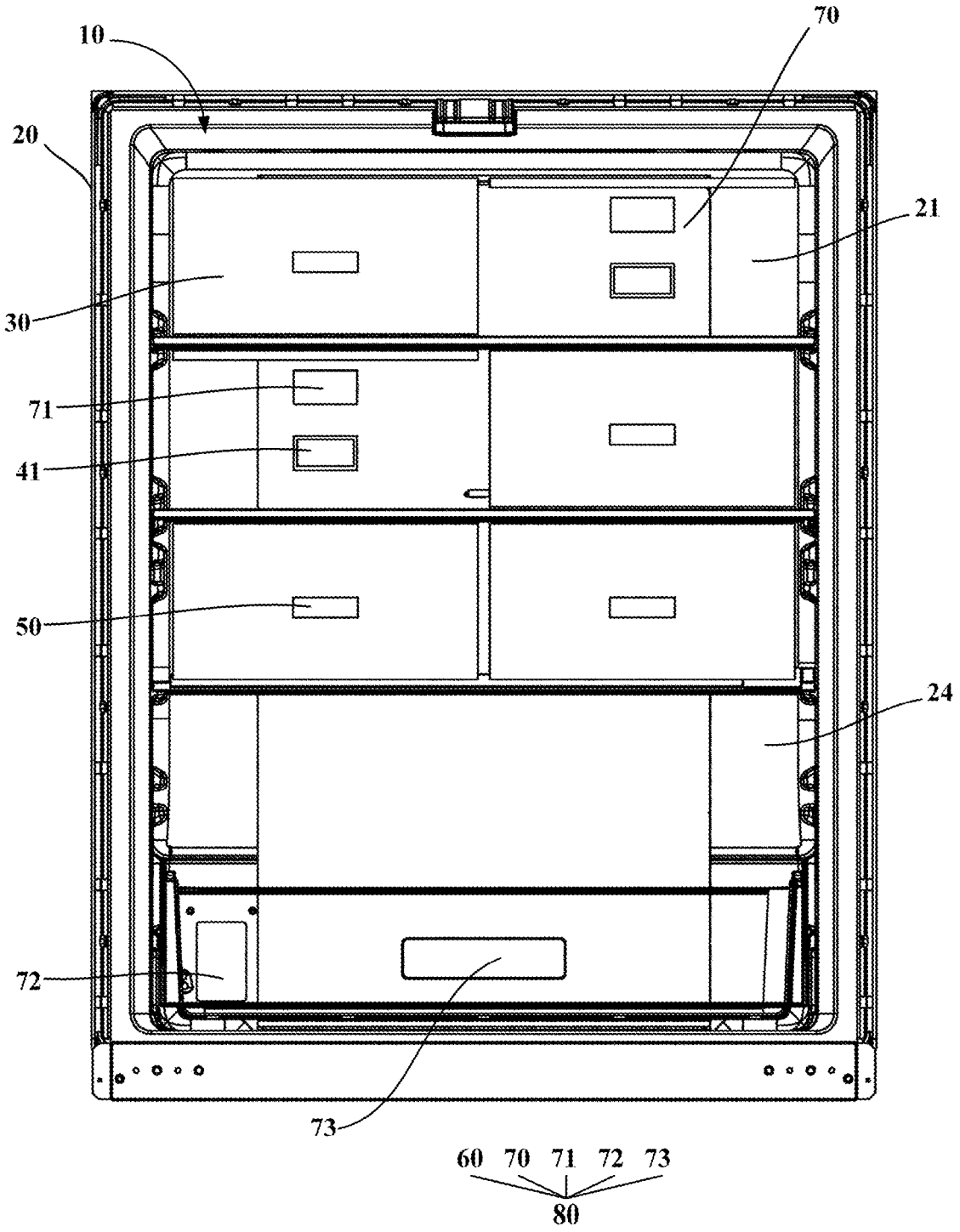
FIG. 2 is a schematic front view of a partial structure of the refrigerating and freezing device shown in FIG. 1.
Figure 3:
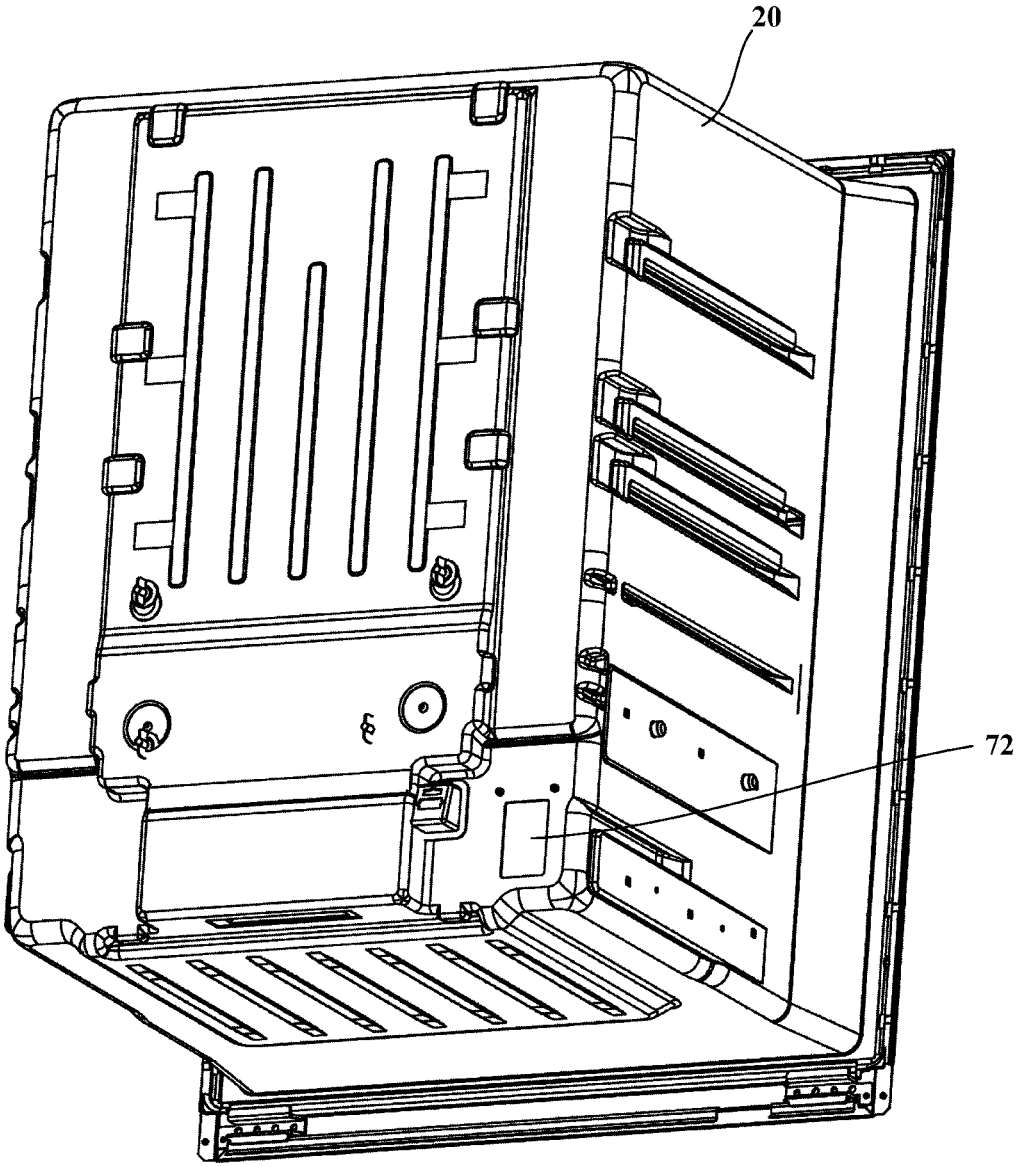
FIG. 3 is a schematic rear view of the refrigerating and freezing device shown in FIG. 1.
Figure 4:
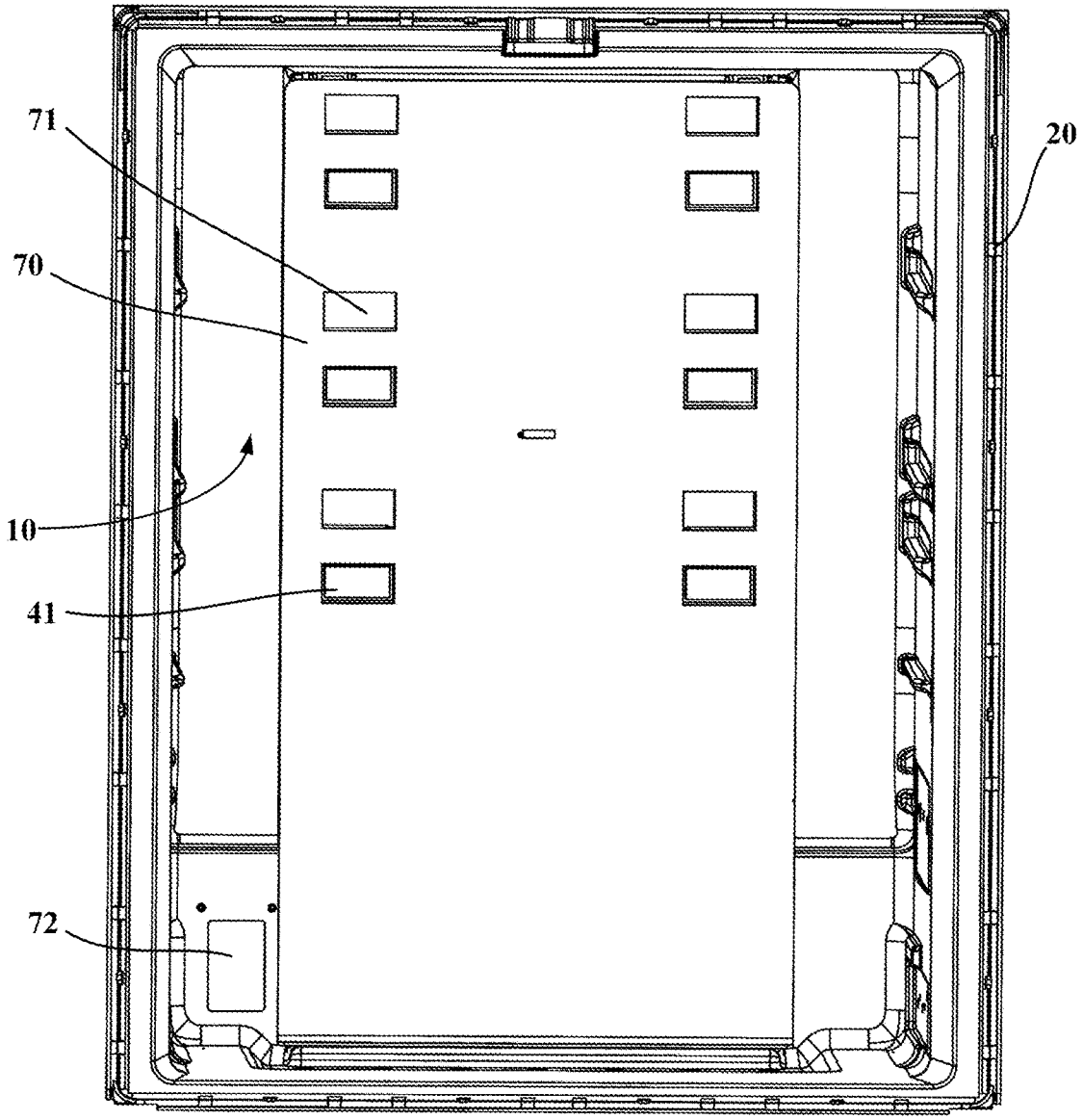
FIG. 4 is a schematic partial structural diagram of the refrigerating and freezing device shown in FIG. 1.
Figure 5:
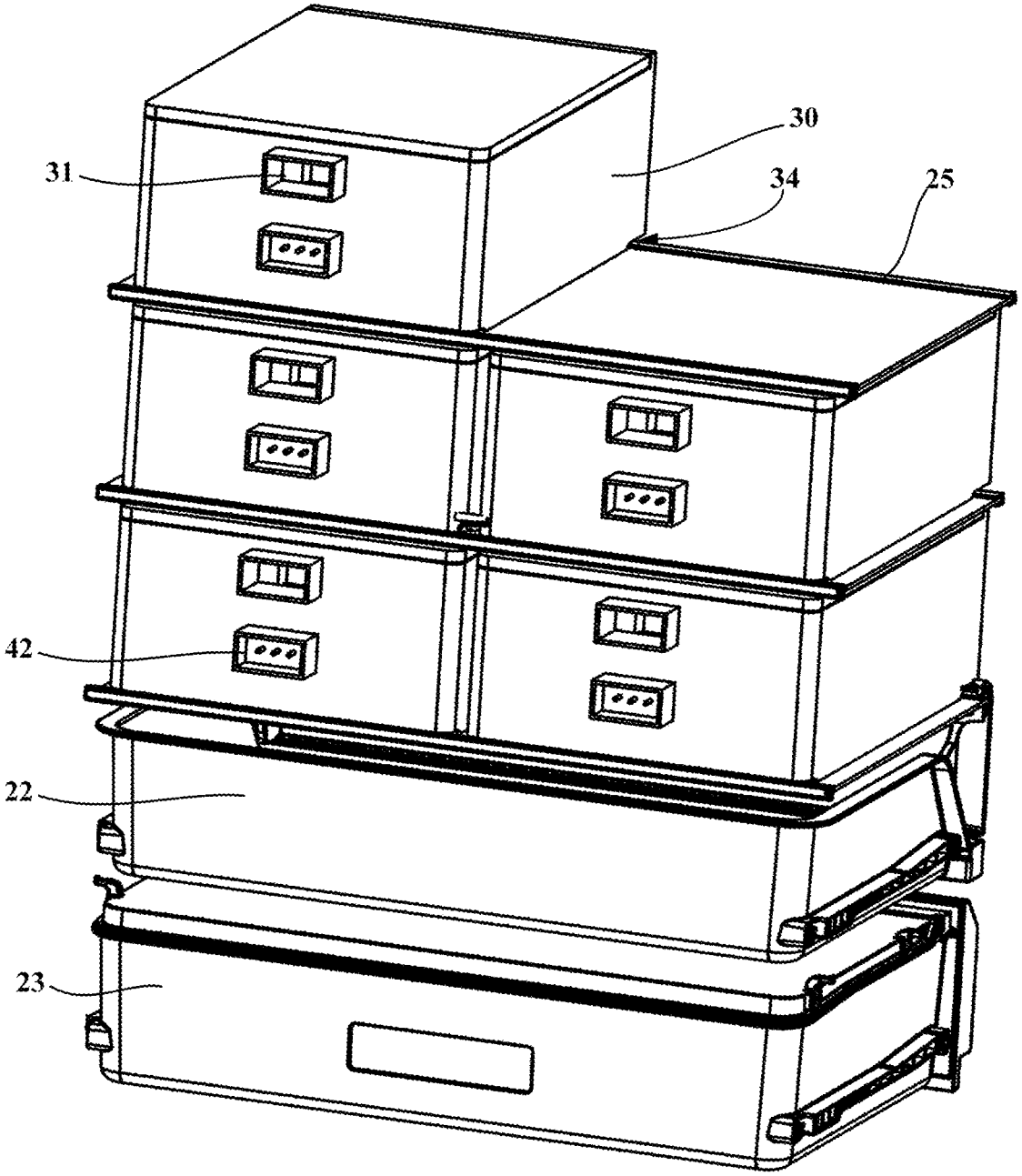
FIG. 5 is a schematic partial structural diagram of the refrigerating and freezing device shown in FIG. 1.
Figure 6:
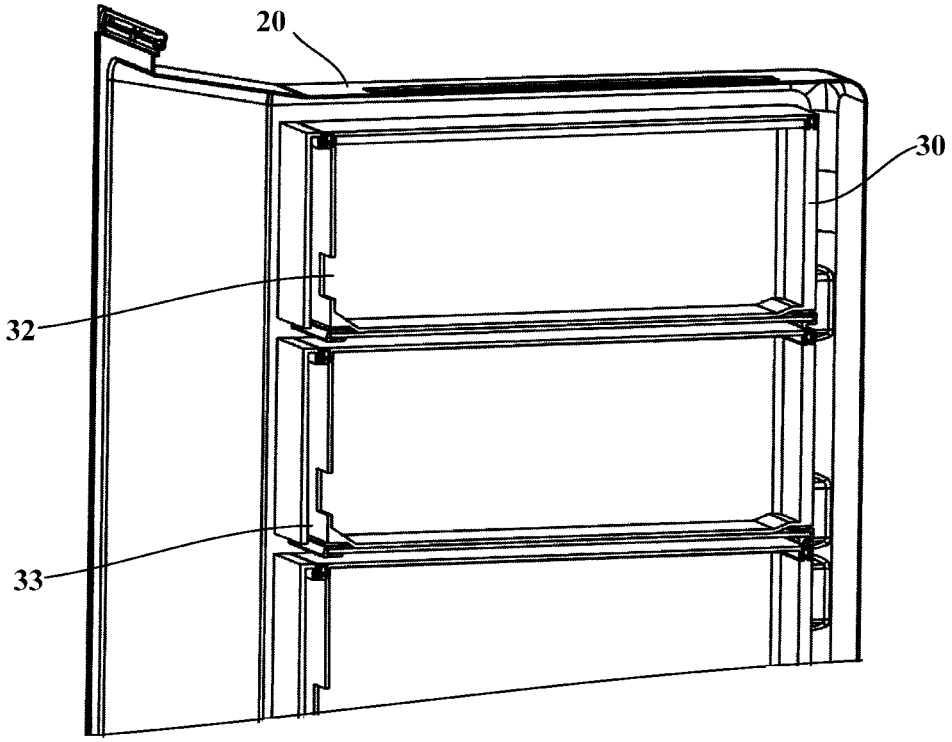
FIG. 6 is a schematic cross-sectional view of a partial structure of the refrigerating and freezing device shown in FIG. 1.
Figure 7:
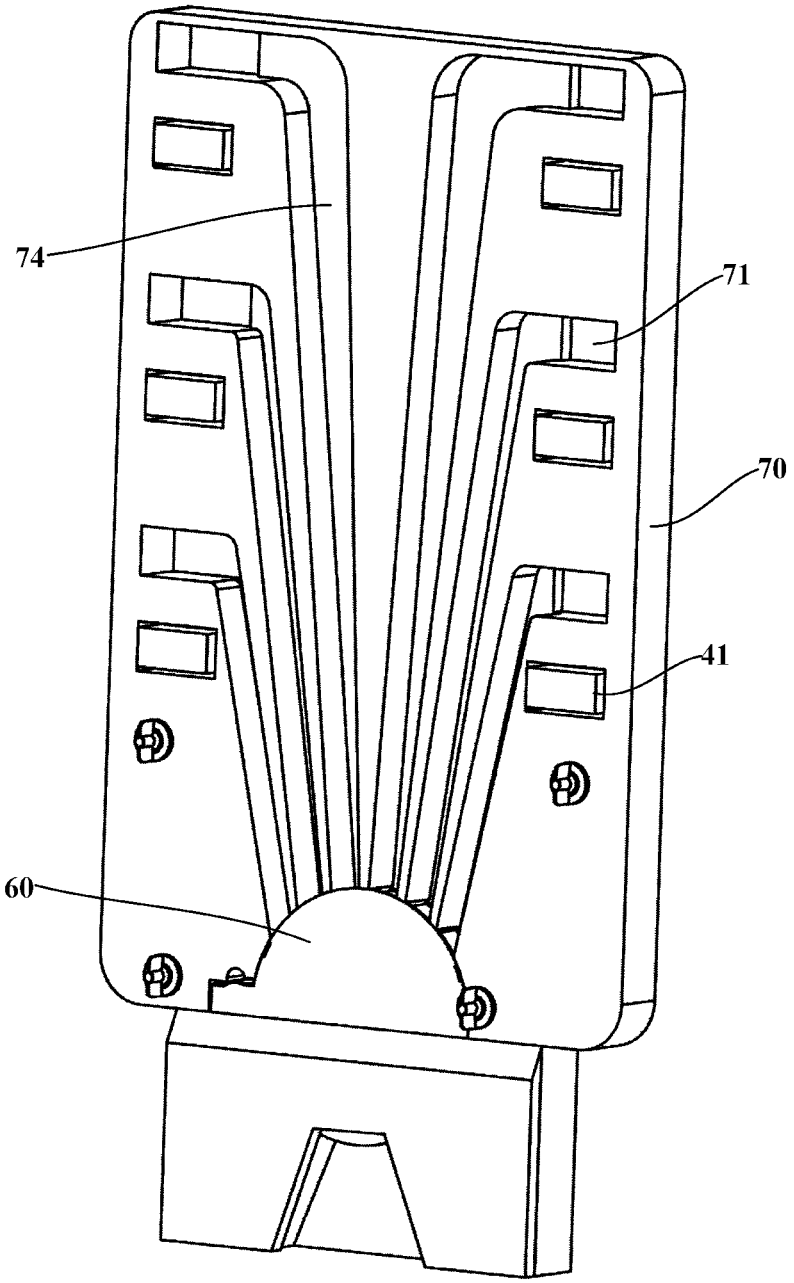
FIG. 7 is a schematic partial structural diagram of an air supply assembly in the refrigerating and freezing device shown in FIG. 1.
Figure 8:
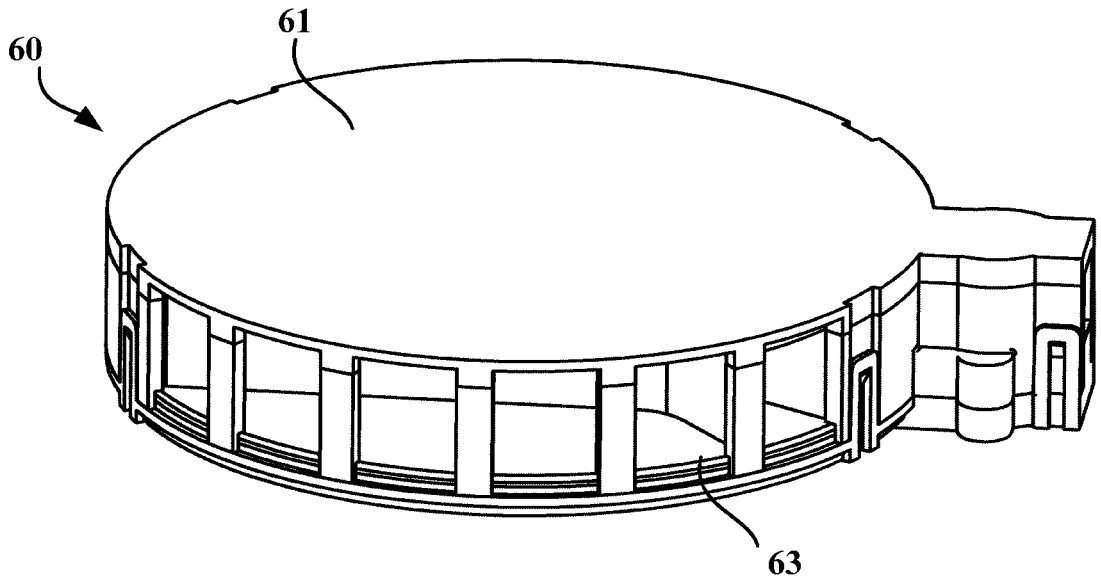
FIG. 8 is a schematic structural diagram of an on-off control device in the refrigerating and freezing device shown in FIG. 1.
Figure 9:
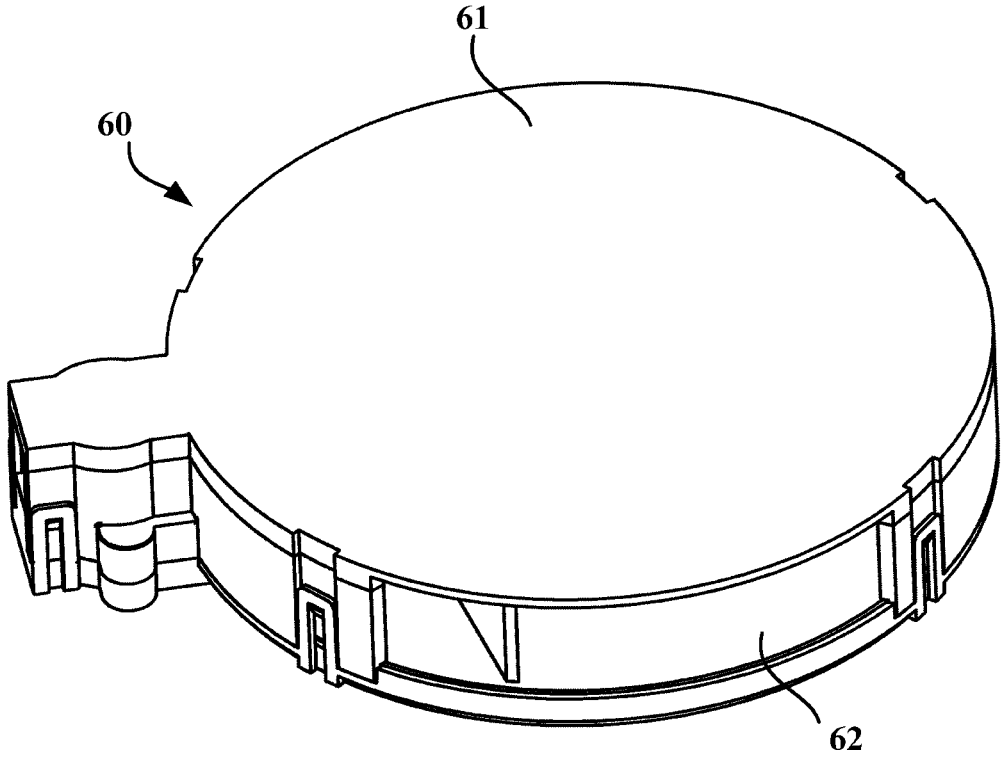
FIG. 9 is another schematic structural diagram of the on-off control device shown in FIG. 8.
Figure 10:
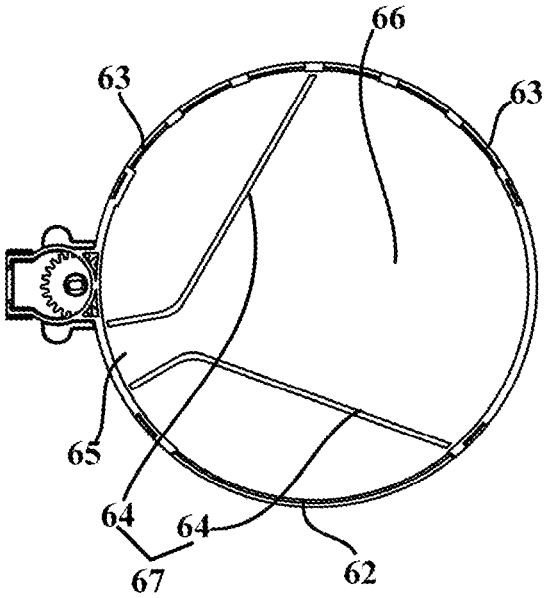
FIGS. 10 to 17 are schematic structural diagrams of an adjusting member of the on-off control device shown in FIG. 8 at various preset positions.
Figure 11:
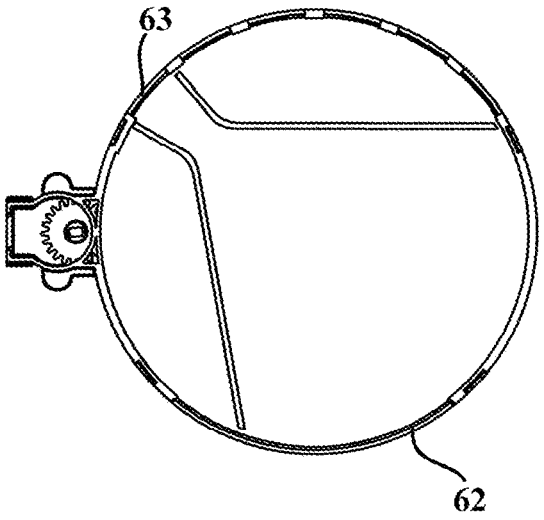
Figure 12:
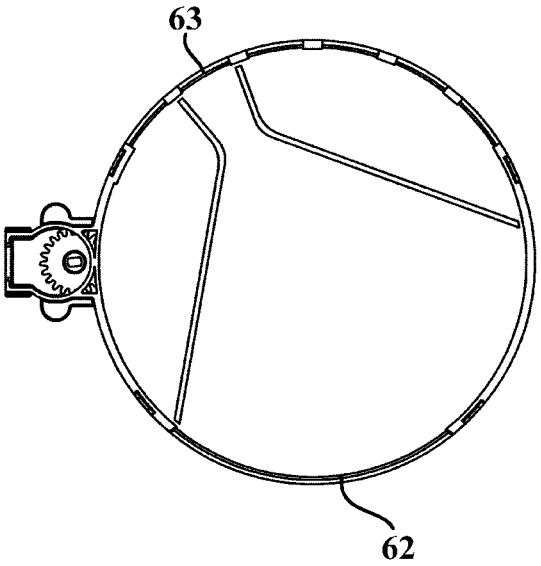
Figure 13:
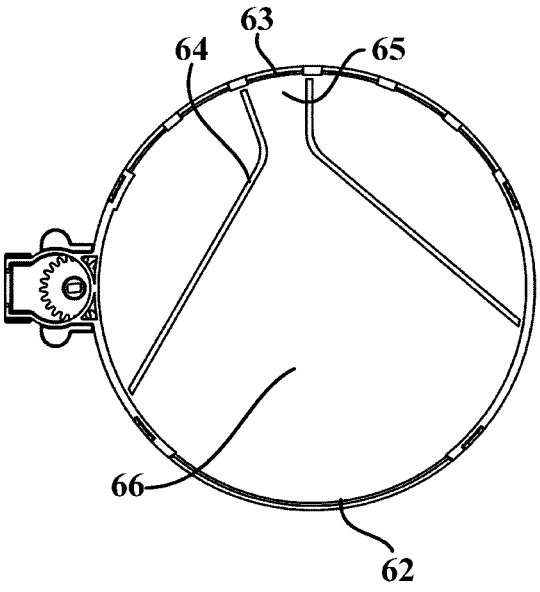
Figure 14:
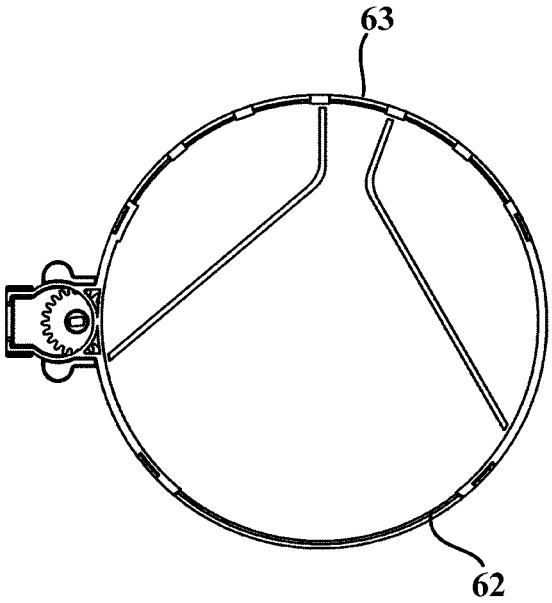
Figure 15:
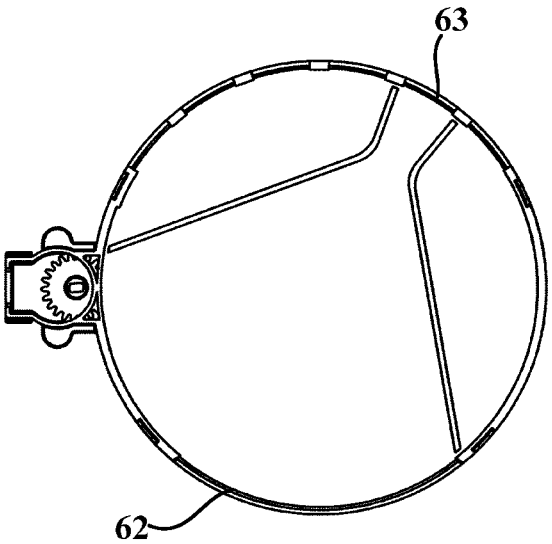
Figure 16:
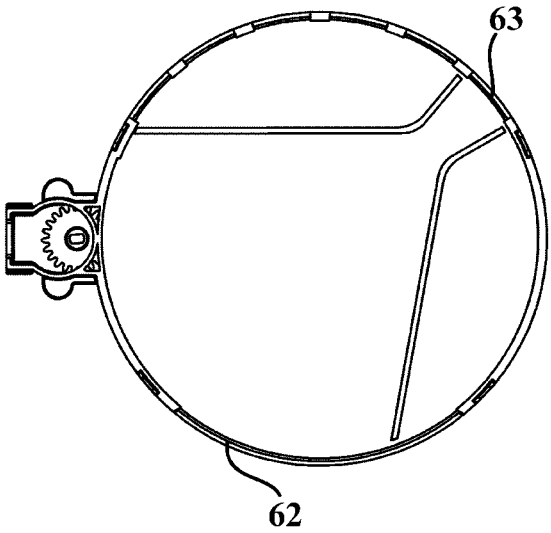
Figure 17:
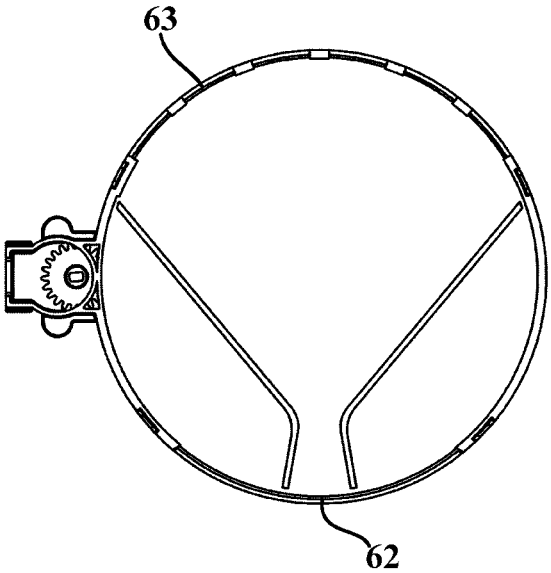

FIG. 1 is a schematic structural diagram of a refrigerating and freezing device according to an embodiment of the present invention. As shown in FIG. 1 and referring to FIGS. 2 to 17, an embodiment of the present invention provides a refrigerating and freezing device. The refrigerating and freezing device includes a refrigerator body 20, a storage compartment 10 is confined in the refrigerator body 20, and the refrigerating and freezing device also has a door for opening and closing the storage compartment 10. The storage compartment 10 may preferably be a refrigerating compartment, and in the refrigerator body there may also be a freezing compartment, a variable temperature compartment, etc. The temperature range in the freezing compartment is generally −22° ° C. to −14° C. The variable temperature compartment can be randomly adjusted to −18° C. to 8° C. Of course, the storage compartment 10 may also be other types of compartments, such as a freezing compartment and a variable temperature compartment.

A refrigeration system is configured to provide cold energy to the storage compartment 10. In some embodiments, the refrigeration system may be a refrigeration cycle system composed of a compressor, a condenser, a throttling device, an evaporator and so on. The evaporator is configured to directly or indirectly provide cold energy to the storage compartment 10. Since the refrigeration system of the refrigerating and freezing device itself is well-known to those skilled in the art, details are not described herein again. In addition, a cooling chamber may be disposed in the refrigerator body 20, specifically on a rear side of the freezing compartment. The cooling chamber is used to accommodate the evaporator. The number of cooling chambers and evaporators may be one or more. When there is one evaporator, it can provide cold energy for all compartments; when there are multiple evaporators, each evaporator can provide cold energy for one compartment.

At least one shelf and at least one vertical partition may be disposed in the storage compartment 10, so that the storage compartment 10 is partitioned into a plurality of first spaces 21 by the shelves and the vertical partitions. The plurality of first spaces 21 include first spaces 21 arranged in at least two columns, and the first spaces 21 in each column are sequentially disposed in a vertical direction, wherein the number of first spaces 21 is equal or unequal in any two columns. For example, two columns of first spaces 21 may be arranged, with three first spaces 21 in one column and two first spaces 21 in the other column. Alternatively, the number of first spaces 21 in each column may be three.

The refrigerating and freezing device may further include a plurality of drawers 30 and an air channel system 80. Each drawer 30 is mounted in one first space 21, and each drawer 30 has an air inlet 31 and a return air outlet 32. The air channel system 80 may have a plurality of first air supply outlets 71, a main return air outlet 72 and an on-off control device 60. Each first air supply outlet 71 is communicated with the cooling chamber and the air inlet 31 of one drawer 30, the return air outlet 32 of each drawer 30 is communicated with the main return air outlet 72, and the main return air outlet 72 is communicated with the cooling chamber. The on-off control device 60 is configured to control air flow from the cooling chamber to flow to one or more of the plurality of first air supply outlets 71, and then control all or part of the air flow to flow to the corresponding drawers 30, thus controlling the temperature in the corresponding drawers 30. Specifically, the on-off control device 60 enables air flow from the cooling chamber to flow to only one drawer 30, or to flow to two or more drawers 30 at the same time, that is, it is used to adjust the air supply of each drawer 30.

In some embodiments of the present invention, a rear part of the storage compartment 10 is provided with the plurality of first air supply outlets 71 and the main return air outlet 72. A rear part of each drawer 30 is provided with the air inlet 31, and a front part of each drawer 30 is provided with the return air outlet 32. For example, the air channel system 80 includes an air supply assembly 70, which is disposed at the rear part of the storage compartment 10 and provided with the plurality of first air supply outlets 71. The storage compartment 10 is also partitioned into at least one second space 24, and the at least one second space 24 is located on a lower side of the plurality of first spaces 21; a rear part of one second space 24 is provided with the main return air outlet 72.

In some embodiments of the present invention, each drawer 30 has a rear wall, a front wall, and a front plate disposed on a front side of the front wall; the rear wall is provided with the air inlet 31, and the air inlet 31 is inserted into one first air supply outlet 71; an upper end of the front plate is connected to an upper end of the front wall to form a return air channel 33 with an opening facing downward; and the front wall is provided with the return air outlet 32. There may be one second space 24 in which a fruit and vegetable box 22 and a sealed box 33 below the fruit and vegetable box 22 are disposed. The air channel system 80 further has a second air supply outlet 73 communicated with the sealed box 33. The fruit and vegetable box 22 is disposed in the second space 24 in a drawable manner. The sealed box 33 may include a sealing part and a moving part, and the moving part can be mounted on the sealing part or the refrigerator body in a drawable manner. For example, the sealing part may be a sealing cylinder or a sealing cover, and the moving part may be a drawer box. When a drawer 30 needs to be cooled, air is transmitted to the corresponding drawer 30 through the first air supply outlet 71 and the air inlet 31. The return air outlet 32 of the drawer is hidden in the front of the drawer 30 to form a convection channel, that is, the return air channel 33. The air flows out of the drawer 30, then flows down to deliver cold energy to the fruit and vegetable box below, and finally returns from the main return air outlet 72.

In some embodiments of the present invention, the refrigerating and freezing device may further include a level generating device 50 configured to generate a plurality of level instruction sets; each level instruction set includes a plurality of level instructions, and correspondingly controls a drawer 30; each level instruction includes control information that controls the corresponding drawer to be at a target temperature or within a target temperature range, so that the refrigerating and freezing device controls the on-off control device 60 according to each level instruction and then controls the temperature in the corresponding drawer 30.

For example, in some embodiments, the level generating device 50 includes a plurality of display control panels disposed at front parts of the respective drawers 30, and each display control panel is configured to receive a signal and generate a level instruction of a level instruction set; and each display control panel is also configured to display recommended types of items stored in the corresponding drawer 30. In some embodiments, a user can click on a symbol of a type of items displayed on the display control panel to generate a signal for the corresponding display control panel to generate a level instruction. Further, each display control panel can be used for inputting information by means of sliding, clicking, etc. The display control panels may also be called display touch screens, which can display option buttons for vegetables, fruits, dried food, milk, seasonings, tropical fruits, baby's only, etc. The user clicks the corresponding option button to generate a corresponding level instruction. When the user needs to store something, the drawer 30 is switched to a corresponding state. In some alternative embodiments of the present invention, the level generating device 50 may be a main touch screen of the refrigerating and freezing device.

In other embodiments, the level generating device 50 includes a plurality of adjustment buttons, and indicator icons corresponding to respective level instructions of the adjustment buttons. Each indicator icon includes at least information suggesting the types of items stored in the corresponding drawer 30. Each adjustment button may be a mechanical key such as a knob. The indicator icons may be icons disposed near the adjustment buttons inside the refrigerator body by means of carving, silk printing, hollowing, etc. For example, the indicator icons may be symbols of representative items suggesting the types of items stored in the corresponding drawers 30. Further, each indicator icon includes at least a target temperature or a target temperature range in the corresponding drawer 30. The level generating device 50 may further include a plurality of indicator lights. Each level instruction of each adjustment button is associated with an indicator light, so that when the adjustment button indicates the corresponding level instruction, the corresponding indicator light turns on, and then the corresponding indicator icon is highlighted, that is, lighted, to facilitate user's observation. Alternatively, the indicator icons may also be displayed on a display screen, which can combine the mechanical keys with the display of the display screen. Further, the indicator icons may also be directly characters, that is, the display screen can display all the information associated with the corresponding level instruction.

In this embodiment, because of the air channel system 80 and the level generating device 50, each drawer 30 of the refrigerating compartment of a refrigerator can be independently adjusted for multiple temperature levels such as 2° C., 5° C., and 10° C. (low, medium, and high), the user can adjust the temperature of each drawer 30 of the refrigerator according to his/her needs and habits, different food can be stored at the best environment zones through the balanced control of temperature and humidity, the user can be guided to correctly place the food in the best storage spaces to reduce waste, and food that cannot be put in the refrigerator before can also be put in to extend its shelf life. Prior to this application, the temperature of the refrigerating compartment of a refrigerator is the same, but the best storage temperature and humidity of different food are different, resulting in users not dare to put some low-temperature instant food and tropical melons and fruits into the refrigerator. For food that cannot be eaten immediately due to the low temperature, users can only put it outside; for tropical melons and fruits that need to be stored at 8-10° C. for the best preservation time, users also dare not put them in the refrigerator. Food that is not put in the best temperature range in the refrigerator spoils quickly to cause serious waste. The embodiment of the present invention can freely adjust the temperature of each drawer 30 of the refrigerator according to the needs of the user, so that food is stored in the best storage spaces, the user is guided to correctly place food in the best storage spaces, and food can be stored at the best temperature and humidity environment to greatly improve freshness. Each drawer 30 can realize multi-level changes and free switching of temperature. Further, when each level instruction set includes a lot of level instructions, every time the target temperature in the drawer 30 changes by one degree Celsius, it can be used as a new level. This may also be called stepless level adjustment. For example, there may be 11 levels between 0° ° C. and 10° C., so that each drawer 30 can be randomly adjusted between 0° ° C. and 10° C. Of course, there may be only three levels between 0° C. and 10° C.: 0° C. ice temperature zone, 4° C. golden zone, and 10° C. tropical fruit zone.

In some embodiments of the present invention, the refrigerating and freezing device may also have a memory device, which is a main memory device, or may have a plurality of memory modules respectively disposed in the plurality of drawers 30. When in use, the user can freely switch food. According to the food that the user switches, the drawer 30 automatically matches the temperature range corresponding to the food, the memory device automatically memorizes the temperature range, and the drawer 30 can automatically identify its own temperature range when switched to any position.

In some embodiments of the present invention, the refrigerating and freezing device further includes a plurality of electrical connection sockets 41, and each electrical connection socket 41 is disposed at the rear part of a first space 21; the rear part of each drawer 30 has an electrical connection plug 42 inserted into the corresponding electrical connection socket 41 to transmit signals and/or provide power; each display control panel is connected to the corresponding electrical connection plug 42. Preferably, the plurality of electrical connection sockets 41 are disposed on the air supply assembly 70. Further, a temperature sensor may be disposed in each drawer 30 to detect the temperature change in the corresponding drawer 30, so that air is supplied only when the drawer 30 needs air supply, which can prevent food from being super-cooled and save energy.

In some embodiments of the present invention, the user can also determine the number of drawers 30 to be placed according to his/her needs, and the user can directly place items in the first spaces 21 where the drawers 30 are not placed. For example, the numbers of the first spaces 21 and the drawers 30 are both six, and the user can place four drawers 30, two drawers 30, etc. in the first places according to requirements. The positions of the six drawers 30 may also be switched arbitrarily. Except for the air inlet 31 and the return air outlet 32, each drawer 30 may be designed into a sealed structure to prevent the air flow between the drawers 30 from temperature interfering and odor crossing. Further, a front end of a bottom wall of each first space 21 is provided with a stop bar 25, and a bottom front end of each drawer 30 is provided with a stop groove 34 or stop surface matching the corresponding stop bar 25, so that each stop bar 25 hinders the drawer 30 from moving forward after the corresponding drawer 30 is located in the corresponding first space 21. The stop bar 25 may also be a decorative bar disposed at a front end of the shelf. The combination of the electrical connection sockets 41 and the electrical connection plugs 42 can also prevent the drawers 30 from falling.

In some embodiments of the present invention, as shown in FIGS. 8 to 17, the on-off control device 60 may include a shell 61 and an adjusting member 67. The shell 61 has an air flow inlet 62, and a circumferential wall of the shell 61 has a plurality of air flow outlets 63. The adjusting member 67 is rotatably disposed in the shell 61 and has two air flow guide plates 64 symmetrically disposed, and each air flow guide plate 64 is parallel to an axial direction of the shell 61. One ends of the two air flow guide plates 64 confine a first air flow opening 65; the adjusting member 67 is configured to be rotatable to a plurality of preset positions, and the first air flow opening 65 is communicated with one air flow outlet 63 at each preset position, so that air flow entering between the two air flow guide plates 64 via the air flow inlet 62 enters the corresponding air flow outlet 63. The size of the first air flow opening 65 may be equivalent to the size of each air flow outlet 63. When the on-off control device 60 is working, one air flow outlet 63 can be in an on state to deliver air flow to a target space communicated with the air flow outlet 63.

Further, the other ends of the two air flow guide plates 64 confine a second air flow opening 66. The circumferential wall of the shell 61 is provided with the air flow inlet 62, and when the first air flow opening 65 is communicated with an air flow outlet 63, the second air flow opening 66 is communicated with the air flow inlet 62. The second air flow opening 66 may be larger than the first air flow opening 65, so that the adjusting member 67 can be rotated to a position where the first air flow opening 65 is communicated with the air flow inlet 62 and the second air flow opening 66 is communicated with the plurality of air flow outlets 63. Preferably, the adjusting member 67 can also be rotated to a position where one air flow guide plate 64 shields the air flow inlet 62 or a position where one air flow guide plate 64 shields all the air flow outlets 63. As shown in FIGS. 10 to 17, the number of air flow outlets 63 may be six, and the two air flow guide plates 64 may enable the on-off control device 60 to have 8 operating states, including states where the air flow outlets 63 are individually opened, a state where all the air flow outlets 63 are opened, and a state where the air flow inlet 62 is closed (that is, all the air flow outlets 63 are closed).

In some preferred embodiments of the present invention, each air flow guide plate 64 includes a first plate section and a second plate section connected to each other, the distance between tail ends of the two second plate sections is greater than the distance between tail ends of the two first plate sections, and the first plate section is shorter than the second plate section; and the first air flow opening 65 is formed between the tail ends of the two first plate sections. By using the first plate section and the second plate section, air can flow smoothly, low noise is generated, and the first air flow opening 65 and the second air flow opening 66 that meet the requirements can be confined, so that the on-off control device 60 is simple in structure and low in cost.

In order to facilitate the automatic control of the adjusting member 67, the on-off control device 60 further includes a driving device configured to drive the adjusting member 67 to rotate; and the driving device includes a motor, a first gear and a second gear. The first gear is disposed in the shell 61 and connected with the adjusting member 67. The motor is disposed on the radial outer side of the shell 61, which can reduce the thickness of the on-off control device 60, so that the on-off control device 60 is particularly suitable for refrigerating and freezing devices such as refrigerators. The second gear is mounted on an output shaft of the motor and meshes with the first gear, so that when the motor rotates, the second gear and the first gear drive the adjusting member 67 to rotate, and the working state of the on-off control device 60 can be controlled by controlling the rotation of the motor.

Each air flow outlet 63 of the on-off control device 60 is communicated with a drawer 30 via one or more first air supply outlets 71; the air flow inlet 62 is communicated with the cooling chamber. The adjusting member 67 may be configured to control air flow from the air flow inlet 62 to flow to one or all of the plurality of air flow outlets 63, and then control all or part of the air flow to flow to the corresponding drawers 30. That is, each air flow outlet 63 is communicated with a drawer 30; when the air flow outlet 63 is closed, the corresponding drawer 30 is stopped from being supplied with cold air; and when the air flow outlet 63 is opened, the corresponding drawer 30 can be supplied with cold air. The on-off control device 60 is preferably disposed in the air supply assembly 70, a plurality of air supply channels 74 may be disposed in the air supply assembly 70, and each air supply channel 74 is communicated with an air flow outlet and a first air supply outlet 71. The air supply assembly 70 also has an air inflow port, which may be communicated with the cooling chamber via an air inlet pipe, and a fan for promoting air flowing may be disposed at an outlet of the cooling chamber.

So far, those skilled in the art should realize that although multiple exemplary embodiments of the present invention have been illustrated and described in detail herein, many other variations or modifications that conform to the principle of the present invention may still be directly determined or derived from the disclosure of the present invention without departing from the spirit and scope of the present invention. Therefore, the scope of the present invention should be understood and deemed to cover all these other variations or modifications.

What is claimed is:

1. A refrigerating and freezing device comprising:

a storage compartment partitioned into a plurality of first spaces;

an air channel system having a plurality of first air supply outlets, a main return air outlet and an on-off control device;

a plurality of drawers, wherein each drawer is mounted in one of the first spaces, each drawer has an air inlet and a return air outlet, each air inlet is communicated with one of the first air supply outlets, and each return air outlet is communicated with the main return air outlet;

a level generating device configured to generate a plurality of level instruction sets;

wherein the on-off control device is configured to control air flow to one or more of the plurality of first air supply outlets, and then control all or part of the air flow to flow to the corresponding drawers, thus controlling a temperature in the corresponding drawers; and wherein each level instruction set comprises a plurality of level instructions, and correspondingly controls one of the drawers; each level instruction comprises control information that controls the corresponding drawer to be at a target temperature or within a target temperature range, so that the refrigerating and freezing device controls the on-off control device according to each level instruction and then controls the temperature in the corresponding drawer.

2. The refrigerating and freezing device according to claim 1, wherein a rear part of the storage compartment is provided with the plurality of first air supply outlets and the main return air outlet;

a rear part of each drawer is provided with the air inlet, and a front part of each drawer is provided with the return air outlet.

3. The refrigerating and freezing device according to claim 1, wherein the level generating device comprises a plurality of display control panels disposed at front parts of the respective drawers, and each display control panel is configured to receive a signal and generate the level instructions of one of the level instruction sets.

4. The refrigerating and freezing device according to claim 3, further comprising a plurality of electrical connection sockets, wherein each electrical connection socket is disposed at a rear part of one of the first spaces; and the rear part of each drawer has an electrical connection plug inserted into the corresponding electrical connection socket to transmit signals and/or supply power; each display control panel is connected to the corresponding electrical connection plug.

5. The refrigerating and freezing device according to claim 2, wherein each drawer has a rear wall, a front wall, and a front plate disposed on a front side of the front wall;

the rear wall is provided with the air inlet, and the air inlet is inserted into one of the first air supply outlets;

an upper end of the front plate is connected to an upper end of the front wall to form a return air channel with an opening facing downward, and the front wall is provided with the return air outlet; and the storage compartment is partitioned into at least one second space, and the at least one second space is located on a lower side of the plurality of first spaces; a rear part of one second space is provided with the main return air outlet.

6. The refrigerating and freezing device according to claim 5, wherein the plurality of first spaces are arranged in at least two columns, and the first spaces in each column are sequentially disposed in a vertical direction, wherein a number of first spaces is equal or unequal in any two columns;

a number of the second space is one, and a fruit and vegetable box and a sealed box below the fruit and vegetable box are disposed in the second space; and the air channel system further has a second air supply outlet communicated with the sealed box.

7. The refrigerating and freezing device according to claim 1, wherein a front end of a bottom wall of each first space is provided with a stop bar, and a bottom front end of each drawer is provided with a stop groove or stop surface matching the corresponding stop bar, so that each stop bar hinders the drawer from moving forward after the corresponding drawer is located in the corresponding first space.

8. The refrigerating and freezing device according to claim 4, wherein the air channel system comprises an air supply assembly, which is disposed at a rear part of the storage compartment and provided with the plurality of first air supply outlets and the plurality of electrical connection sockets.

9. The refrigerating and freezing device according to claim 1, wherein the on-off control device comprises:

a shell having an air flow inlet, a circumferential wall of the shell having a plurality of air flow outlets; and an adjusting member rotatably disposed in the shell and having two air flow guide plates symmetrically disposed, either of the air flow guide plates being parallel to an axial direction of the shell; wherein one ends of the two air flow guide plates confine a first air opening; the adjusting member is configured to be rotatable to a plurality of preset positions, and the first air opening is communicated with one of the air flow outlets at each preset position, so that air flow entering between the two air flow guide plates via the air flow inlet enters the corresponding air flow outlet; and each air flow outlet is communicated with one of the drawers via the first air supply outlet.

10. A refrigerating and freezing device comprising:

a storage compartment partitioned into a plurality of first spaces;

an air channel system having a plurality of first air supply outlets, a main return air outlet and an on-off control device;

a plurality of drawers, wherein each drawer is mounted in one of the first spaces, each drawer has an air inlet and a return air outlet, each air inlet is communicated with one of the first air supply outlets, and each return air outlet is communicated with the main return air outlet;

the on-off control device is configured to control air flow to one or more of the plurality of first air supply outlets, and then control all or part of the air flow to flow to the corresponding drawers, thus controlling a temperature in the corresponding drawers;

wherein a rear part of the storage compartment is provided with the plurality of first air supply outlets and the main return air outlet;

wherein a rear part of each drawer is provided with the air inlet, and a front part of each drawer is provided with the return air outlet;

wherein each drawer has a rear wall, a front wall, and a front plate disposed on a front side of the front wall;

wherein the rear wall is provided with the air inlet, and the air inlet is inserted into one of the first air supply outlets;

wherein an upper end of the front plate is connected to an upper end of the front wall to form a return air channel with an opening facing downward, and the front wall is provided with the return air outlet; and wherein the storage compartment is partitioned into at least one second space, and the at least one second space is located on a lower side of the plurality of first spaces; a rear part of one second space is provided with the main return air outlet.

11. A refrigerating and freezing device comprising:

a storage compartment partitioned into a plurality of first spaces;

an air channel system having a plurality of first air supply outlets, a main return air outlet and an on-off control device; and a plurality of drawers, wherein each drawer is mounted in one of the first spaces, each drawer has an air inlet and a return air outlet, each air inlet is communicated with one of the first air supply outlets, and each return air outlet is communicated with the main return air outlet;

wherein the on-off control device is configured to control air flow to one or more of the plurality of first air supply outlets, and then control all or part of the air flow to flow to the corresponding drawers, thus controlling a temperature in the corresponding drawers; and a front end of a bottom wall of each first space is provided with a stop bar, and a bottom front end of each drawer is provided with a stop groove or stop surface matching the corresponding stop bar, so that each stop bar hinders the drawer from moving forward after the corresponding drawer is located in the corresponding first space.

* * * * *